US005471540A

United States Patent [19]

Maeda

[11] Patent Number: 5,471,540

[45] Date of Patent: Nov. 28, 1995

[54] ELECTROSTATIC LOUDSPEAKER HAVING STATIONARY ELECTRODES FORMED AS MULTIPLE SHEETS INSULATED FROM EACH OTHER

[75] Inventor: Keijiro Maeda, Kanagawa, Japan

[73] Assignee: Sony Corporation, Tokyo, Japan

[21] Appl. No.: 141,887

[22] Filed: Oct. 22, 1993

[51] Int. Cl.[6] ..... H04R 25/00

[52] U.S. Cl. ..... 381/191; 381/116

[58] Field of Search ..... 381/116, 191

[56] References Cited

U.S. PATENT DOCUMENTS

| | | | |
|---|---|---|---|
| 1,622,039 | 3/1927 | Lee | 381/191 |
| 3,135,838 | 6/1964 | Wright | 381/191 |
| 3,136,867 | 6/1964 | Brettell | 381/191 |
| 3,892,927 | 7/1975 | Lindenberg | 179/111 R |
| 3,992,585 | 11/1976 | Turner et al. | 179/1 R |
| 4,383,139 | 5/1983 | Kanchev | 381/191 |

FOREIGN PATENT DOCUMENTS

| | | | |
|---|---|---|---|
| 2900611 | 7/1980 | Germany . | |
| 1059307 | 2/1967 | United Kingdom | 381/191 |
| 1234767 | 6/1971 | United Kingdom | 381/191 |

OTHER PUBLICATIONS

Abstract of Japanese Patent Application No. 58117799, Jul. 13, 1983.

*Primary Examiner*—Stephen Brinich

*Attorney, Agent, or Firm*—Lise A. Rode; Robert P. Biddle; Jerry A. Miller

[57] ABSTRACT

An electrostatic loudspeaker has electrodes 24 and 26 arranging multiple plate electrodes 24A to 24D, 26A to 26D insulated each other on both sides of movable electrodes 12, thereby being capable of efficiently producing a large sound pressure level.

11 Claims, 10 Drawing Sheets

ELECTROSTATIC LOUDSPEAKER HAVING STATIONARY ELECTRODES FORMED AS MULTIPLE SHEETS INSULATED FROM EACH OTHER

FIELD OF THE INVENTION

This invention relates to a speaker system and, more particularly, to an electrostatic loudspeaker system.

BACKGROUND OF THE INVENTION

Heretofore, in this type of electrostatic loudspeaker, the sound pressure can be produced corresponding to the driving signal by impressing the bias voltage (direct current biasing) with the driving signal.

More specifically, as shown in FIG. 1, in a loudspeaker system 1 utilizing an electrostatic speaker, the driving signal outputted from a power amplifier 2 is boosted several times via a boosting transformer 4 an output signal of which is outputted to a speaker element 6.

This speaker element 6 consists of stationary electrodes 8 and 10 which are electrode plates having multiple holes, or perforations, therein. These stationary electrodes are arranged opposing each other with a prescribed distance therebetween. The output signal of the boosting transformer 4 is impressed between these stationary electrodes 8 and 10.

Furthermore, the speaker element 6 includes a diaphragm 12 forming the conductive fine filter on the polyester film for example, and maintains this diaphragm 12 between the stationary electrodes 8 and 10.

The bias voltage of several (kV) is formed by boosting the commercial power source at a power source, between the secondary side middle tap of the boosting transformer 4 and the diaphragm 12.

The power source for forming bias voltage 14 impresses the bias voltage to the diaphragm 12 via resistance 16 having the prescribed resistance value, and thus, the loudspeaker system 1, as a whole, sets sharpness Q at the prescribed value.

With this arrangement, in the loudspeaker system 1, the driving force F to be expressed by the following equation is generated on the diaphragm 12;

$$F = \frac{\epsilon S}{2d0^2} E0\, E\,[N] \tag{1}$$

and the sound pressure corresponding to the driving signal can be provided by elastically vibrating the diaphragm 12 with this driving force F.

Here, * is dielectric constant which, in this case, is 8.85 *10–12 [F/N], S is made up of electrode area (m2), EO and E are bias voltage [V] and voltage of driving signal [V] respectively, d0 is a distance between electrodes [m].

As shown in FIG. 2, the driving force F to be expressed by Equation (1) is produced on the entire diaphragm 12 equally.

On the other hand, in the diaphragm 12, since its member is homogeneous and also its outer circumference is restricted, it is deformed to a circular arc shape and is elastically vibrated as shown by the arrow "a" in FIG. 3.

This means that if the diaphragm 12 is vibrated with a large amplitude in order to obtain large sound pressure, the deformation of the diaphragm 12 becomes larger accordingly and this also means that the center part of the diaphragm 12 touches to the stationary electrodes 8 and 10.

In the speaker system 1, since the distance between stationary electrodes becomes larger, this contact can be avoided. However, if this distance d0 is made larger, it will become necessary to make the bias voltage and the voltage of the driving signal larger in accordance with Equation (1) and accordingly the efficiency becomes worse.

As shown in FIG. 4, this type of speaker system 19 in which the sound pressure would be increased by laminating multiple sets of speaker elements to be formed with a set of stationary electrode and diaphragm has been proposed as one method to obviate the above problems.

More specifically, the speaker system 19 includes the first speaker element with stationary electrodes 8A and 10A and the diaphragm 12A. The bias voltage is supplied to this speaker element through resistance 16A.

Furthermore, the speaker device 19 forms the second speaker element with stationary electrodes 8B and 10B and a diaphragm 12B and supplies the bias voltage to this speaker element via resistance 16B.

Thus, the speaker system 19 is able to produce larger sound pressure as compared with the case of forming with single speaker element.

However, in this speaker system 19, since the potential difference between stationary electrodes 10A and 8B of the first and the second speaker elements becomes large and also it is necessary to decrease the electrostatic capacity between these stationary electrodes 10A and 8B. After all, these stationary electrodes 10A and 8B have to be arranged estranged and as a result, it becomes a problem that its external form becomes large sized.

Furthermore, in the speaker system 19, if the stationary electrodes 10A and 8B are arranged estranged, the mass of air between stationary electrodes 10A and 8B would be increased accordingly; and as a result, the load of diaphragms 12A and 12B will increase.

SUMMARY OF THE INVENTION

In view of the foregoing, an object of this invention is to provide a loudspeaker system which is capable of obtaining large sound pressure efficiently.

The foregoing object and other objects of this invention have been achieved through the provision of an electrostatic loudspeaker system 30 which comprises a pair of stationary electrodes 24 and 26 which are maintained to face each other and which have multiple perforations formed therein and on which a driving signal is impressed. Also included is a diaphragm 12, which is fixed at the outer side and is maintained between a pair of stationary electrodes 24 and 26 and which is a movable electrode that a direct current bias voltage is impressed, for producing the sound pressure by vibrating in accordance with the driving signal, and a boost means for boosting the driving signal impressed to the stationary electrodes 24 and 26. The stationary electrodes 24 and 26 are arranged in front and back of the diaphragm 12 flatly, and simultaneously are composed of multiple sheet electrodes insulated each other. The boost means impresses the driving signal having the different voltages to the multiple sheet electrodes respectively.

Further, according to this invention, in the electrostatic loudspeaker 30, the stationary electrodes 24 and 26 are composed of multiple sheet electrodes having respective specific areas 24A to 24D and 26A to 26D which are formed by dividing the areas from inner side to outer side. The boost means impresses said driving signal to respective sheet electrodes in order that the electric field to be formed between a pair of stationary electrodes 24 and 26 by said driving signal becomes larger in outside circle compared with inside circle.

Further, according to this invention, in the electrostatic loudspeaker system 30, the boost means is composed of a boost transformer 32 for boosting the driving signal, and the boost transformer 32 has at least one tap for outputting the tap output signal having lower voltage than an output signal of secondary side winding, and impresses the output signal of secondary side winding to the sheet electrodes 24D and 26D of the outer circle side, and simultaneously impresses the tap output signal to the sheet electrodes 24A and 26A of the inner circle side.

Further, according to this invention, the electrostatic loudspeaker system 30 comprises a booster circuit for generating direct current bias voltage impressed to the diaphragm and exchangeable batteries for supplying power source to the booster circuit, and the booster circuit and batteries are held temporarily.

Further, according to this invention, the electrostatic loudspeaker system comprises the first and second movable electrodes 12A and 12B maintained separated the prescribed distance and to oppose each other, the first stationary electrode 10A which is maintained between the first and second movable electrodes 12A and 12B, the second and third stationary electrodes 8A and 8B which are maintained separated for the prescribed distance from the first and second movable electrodes 12A and 12B and to oppose to the first and the second movable electrodes 12A and 12B in order to hold the first and second movable electrodes 12A and 12B as well as the first stationary electrode 10A respectively, in the state that the first stationary electrode 10A is maintained between the first and second movable electrodes 12A and 12B, a driving circuit 4 for impressing the opposite polarity driving signal between the first and second stationary electrodes 10A and 8A and the third and first stationary electrodes 8B and 10A, a power source circuit 40 for impressing the opposite polarity direct current bias voltage to the first and second movable electrodes 12A and 12B respectively. The power source circuit 40 has a boost transformer 41 for outputting the secondary output voltage by boosting an alternating voltage, and a multi stage junction circuit formed by connecting the multiple stage numbers of diodes 50 to 57 and condensers 42 to 49 to a ladder shape. a multi-stage voltage doubler rectifier for rectifying said secondary voltage output to double voltage by the multi stage junction circuit and outputting the voltage doubler output.

Further, according to this invention, in the electrostatic loudspeaker system, the power source circuit 40 outputs a plurality of double voltage output from the specific connecting stage among the multi stage junction circuits, and simultaneously the direct current bias voltage is impressed in order that a plurality of multi voltage output are impressed to the first and second movable electrodes 12A and 12B which have the opposite polarity each other.

Further, according to this invention, in the electrostatic loudspeaker system, the first to third stationary electrodes 10A, 8A and 8B are formed by multiple sheet electrodes 10AA to 10AC, 8AA to 8AC and 8BA to 8BC which are arranged flatly and are insulated each other. The driving circuit 32 impresses the driving signals which have different voltage respectively to the sheet electrodes 10AA to 10AC, 8AA to 8AC and 8BA to 8BC.

Further, according to this invention, in the electrostatic loudspeaker system, the stationary electrodes 10A, 8A and 8B are composed of multiple sheet electrodes 10AA to 10AC, 8AA to SAC and 8BA to 8BC having respective specific areas which are formed by dividing from inner side to outer side. The driving circuit 32 impresses the driving signal on respective the sheet electrodes 10AA to 10AC, 8AA to 8AC and 8BA to 8BC in order that the electric field to be formed between each stationary electrodes of the first to third stationary electrodes 10A, 8A and 8B becomes larger in the outer side than the inner side of each stationary electrode.

Further, according to this invention, the electrostatic loudspeaker system includes a speaker unit 6 composed of a pair of stationary electrodes 8 and 10 to be maintained to face each other, in which multiple through holes are formed and the driving signal is impressed, and a diaphragm maintained between a pair of the stationary electrodes 8 and 10, which is movable electrodes that a direct current bias voltage VD is impressed, and the sound pressure is produced by vibrating corresponding to the driving signal; a battery 62 for supplying the driving voltage for forming said direct current bias voltage; and a booster circuit 61 for forming said direct current bias voltage upon boosting said driving voltage. The speaker unit 6, the battery 62 and the booster circuit 61 are maintained altogether en bloc.

Further, according to this invention, in the electrostatic loudspeaker system, the battery 62 is maintained to be exchangeable as compared with the booster circuit 61.

Further, according to this invention, in the electrostatic loudspeaker system, the booster circuit 61 comprises a pair of feedback winding on primary side, a boosting transformer having the middle tap that one side of the battery 62 is connected to primary side winding, and a oscillation circuit having a pair of transistor that emitters are connected to other side of the battery 62 in common, and in the booster circuit 61, the output signals of said feedback winding are formed in order to feedback to the base of a pair of the transistor respectively, and simultaneously the connection point of the emitter is connected to the feedback winding via the diode.

Furthermore, according to this invention, in the electrostatic loudspeaker system, the booster circuit 61 is connected to secondary side winding of the boosting transformer, and simultaneously have a multi stage junction circuit formed by connecting a plurality of diodes and condensers in ladder shape, thus, the multi stage junction circuit rectify to double voltage to generate said direct current bias voltage.

If stationary electrodes 24 and 26 formed by arranging multiple plate electrodes 24A to 24D and 26A to 26D which are insulated each other on both sides of the movable electrode 12, the movable electrode 12 can be vibrated in the form of almost a flat plate by driving these multiple plate electrodes 24A to 24D and 26A to 26D in order that the electric field to be formed between stationary electrodes 24 and 26 by the driving signal becomes larger in the outer boundary side as compared with the inner boundary side.

Furthermore, the second stationary electrode 8A, the first movable electrode 12B and the third stationary electrode 8B are arranged separated for the prescribed distance and to oppose each other successively, and the opposite polarity driving signal is impressed between the first and second electrodes 8A and 10A, and between the third and first stationary electrodes 8B and 10A, and furthermore, if the opposite polarity direct current bias voltage is impressed between the first movable electrode 12A and first and second stationary electrodes 10B and 8A, between the second movable electrode 12B and the first and third stationary electrodes 10A and 8B, the second to third stationary electrode 8A to 8B can be arranged close to each other and the first and second movable electrodes 12A and 12B can be driven with the same phase, and the sound pressure to be expressed by the sum of the first and second movable electrodes 12A and 12B can be obtained.

At this point, if the output voltage of the multi stage voltage doubler rectifier is outputted from the midway of the connection stage of the multi stage connection circuit and simultaneously, the secondary voltage output and the voltage doubler output are outputted, and the opposite polarity direct current bias power source would be impressed, the bias voltage of 2 systems can be formed in utilizing the boosting transformer 41 of one system.

Furthermore, the first to third stationary electrodes 10A 8A to 8C are formed with multiple plate electrodes 10AA to 10AC, 8AA to 8AC and 8BA to 8BC which are insulated each other, and in order that the electric field to be formed between the first to third stationary electrodes 10A, 8A and 8B becomes larger in the outer boundary side of each stationary electrode 10A, 8A and 8B as compared with the inner boundary side, the driving signal maintained at the prescribed signal level will be impressed to each plate electrode 10AA to 10AC, 8AA to 8AC and 8BA to 8BC, movable electrodes 12A and 12B can be driven in the state of almost a flat plate, and thus, the sound pressure can be increased further.

Moreover, the electrostatic loudspeaker can be driven without connecting to the commercial power source by holding the electrostatic speaker 6, the battery 62 and the booster 20 an bloc, by boosting the driving power source of battery 62 and forming the bias voltage VD.

The nature, principle and utility of the invention will become more apparent from the following detailed description when read in conjunction with the accompanying drawings is which like parts are designated by like reference numerals or characters.

DETAILED DESCRIPTION OF THE EMBODIMENT

Preferred embodiments of this invention will be described with reference to the accompanying drawings:

(1) The First Embodiment

Figure 5:
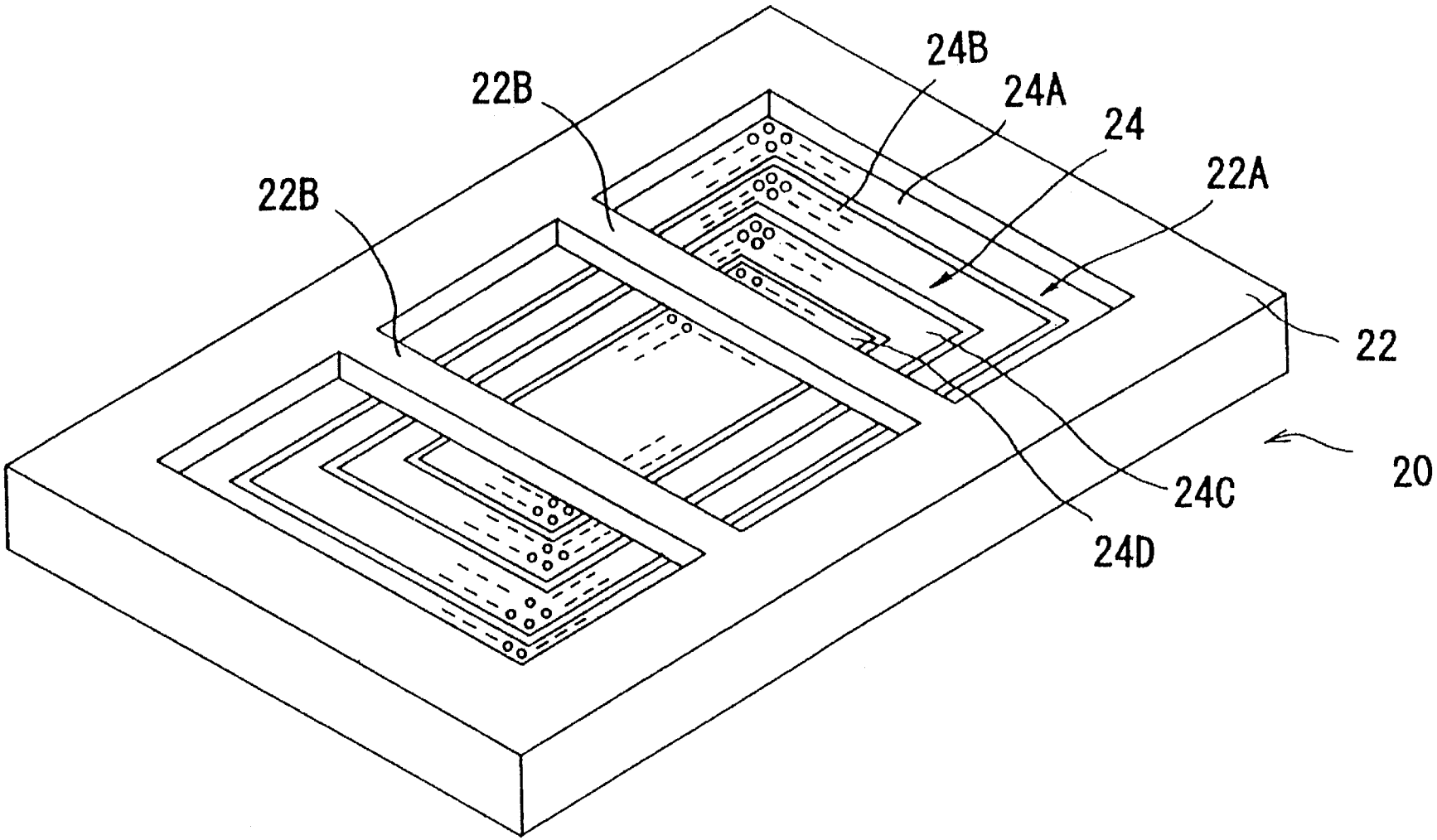
FIG. 5 is a perspective view showing a speaker element according to the embodiment of the present invention.
Figure 6:
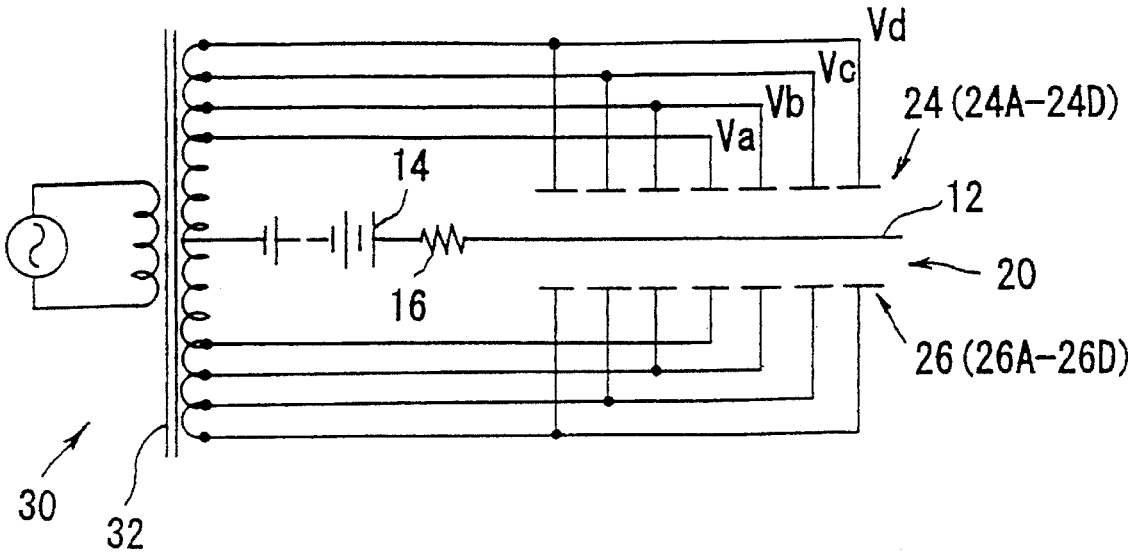
FIG. 6 is a connection diagram showing the speaker system.

In FIGS. 5 and 6, 20 generally shows a speaker element and stationary electrodes 24 and 26 and a diaphragm 12 are stored in the prescribed holder 22.

Here, the holder 22 has a rectangular shaped opening 22A in front and in rear and bar-shaped frames 22B are formed intersecting the opening 22A.

In the speaker element 20, a rectangular plate electrode 24D having a metal plate with multiple holes through, and frame shaped plate electrodes 24A to 24C having multiple through holes are arranged in the opening 22A in front and in back of the holder 22 on the same plane, and thus, these plate electrodes 24A to 24D form stationary electrode 24.

More specifically, in the speaker element 20, a rectangular plate electrode 24D is fixed on the frames 22B and held at the center of opening 22A, and furthermore, a frame shaped plate electrode 24C is fixed on the frames 22B and will be held to surround this plate electrode 24D.

Furthermore, in this speaker element 20, a frame shaped plate electrode 24B is fixed on frames 22B and held to surround the frame shaped plate electrode 24C, and lastly, the frame shaped plate electrode 24A is maintained on the outer frame of frames 22B and a holder 22 to surround the plate electrode 24B.

The speaker element 20 holds plate electrodes 24A to 24D separated for the prescribed distance, and thus, the adjacent plate electrodes 24A to 24D will be insulated and maintained.

Also, as shown in FIG. 6, the plate electrodes 26A to 26D which are provided facing the plate electrodes 24A to 24D are arranged across the diaphragm 12.

As shown in FIG. 6, in the speaker system 30, the driving signal will be impressed to stationary electrodes 24 and 26, which are thus formed of multiple plate electrodes 24A to 24D and 26A to 26D, in order that the plate electrodes placed in more outer side has higher voltage.

More specifically, in the speaker system 30, the boosting transformer 32 forms the secondary winding by forming multiple taps symmetrically to the middle tap, and thus, the more outer side tap is able to output the higher voltage driving signal (Va * Vb * Vc * Vd).

Thus, in the speaker system 30, the output signal of each tap will be connected successively form inside plate electrodes 24A and 26A to outside plate electrodes 24D and 26D, and driving signal will be impressed in order that the plate electrodes placed the outer side has higher voltage.

Figure 7:
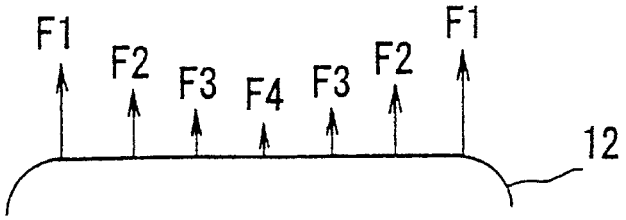
FIG. 7 is a schematic view showing driving force of a diaphragm.

With this arrangement, plate electrodes placed the more outer side can form the larger electric field by the driving signal and as shown in FIG. 7 in the diaphragm 12, the more outer side can obtain the bigger driving force.

Figure 8:
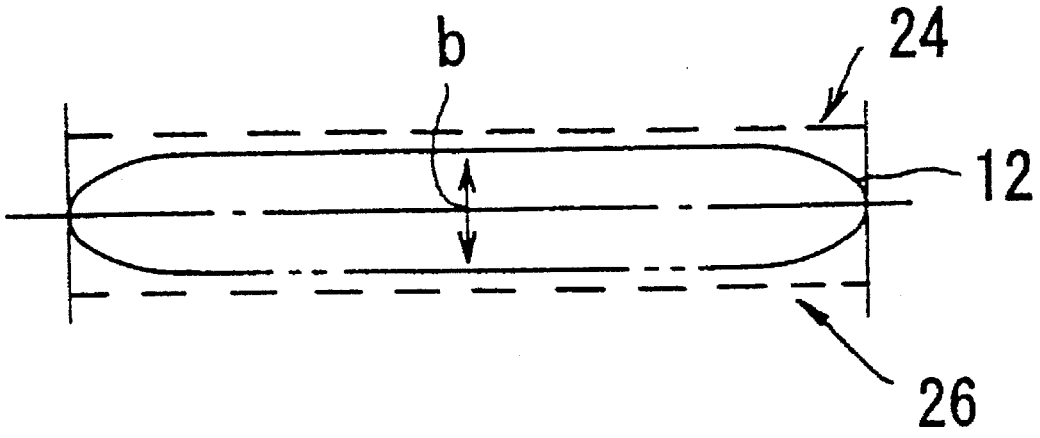
FIG. 8 is a schematic view illustrating vibration of the diaphragm.

Accordingly, in the case where the outside of homogeneous diaphragm 12 is bound and maintained, as shown in FIG. 8 by the arrow "b", the more outer side can be vibrated more elastically transforming, and thus, the diaphragm can be vibrated in the shape of almost a flat plate.

With this arrangement, in the case where the diaphragm 12 vibrates within the limited distance between stationary electrodes 24 and 26, the air can be vibrated with larger volume air as compared with the past, and the larger sound pressure can be obtained as compared with the past on the condition wherein the distance between stationary electrodes is kept the same as in the case of conventional construction; and thus, the larger sound pressure can be obtained efficiently.

Furthermore, if the diaphragm 12 can be vibrated in the shape of almost a flat plate, such as the directional characteristic can be obtained easily, and thus, the desired characteristic can be easily obtained as the speaker equipment on the whole.

Also, if it can be vibrated in the form of almost a flat plate, the vibration mode of the diaphragm 12 can be simplified and thus, the frequency characteristic as the general speaker system can be improved.

Especially, if the diaphragm 12 will be vibrated in the form of almost a flat plate by elastically deforming more largely in the outer side, the resistance control area by the air becomes larger in the low-pass area.

According to the foregoing construction, by forming stationary electrodes dividing into a plurality of areas from the inner boundary side to the outer boundary side and by impressing the driving signal having higher voltage in the outer side area, the diaphragm can be vibrated in the form of almost a flat plate by elastically deforming more largely in the outer side, and thus, the large sound pressure can be obtained efficiently and the characteristic can be improved further.

(2) The Second Embodiment

Figure 9:
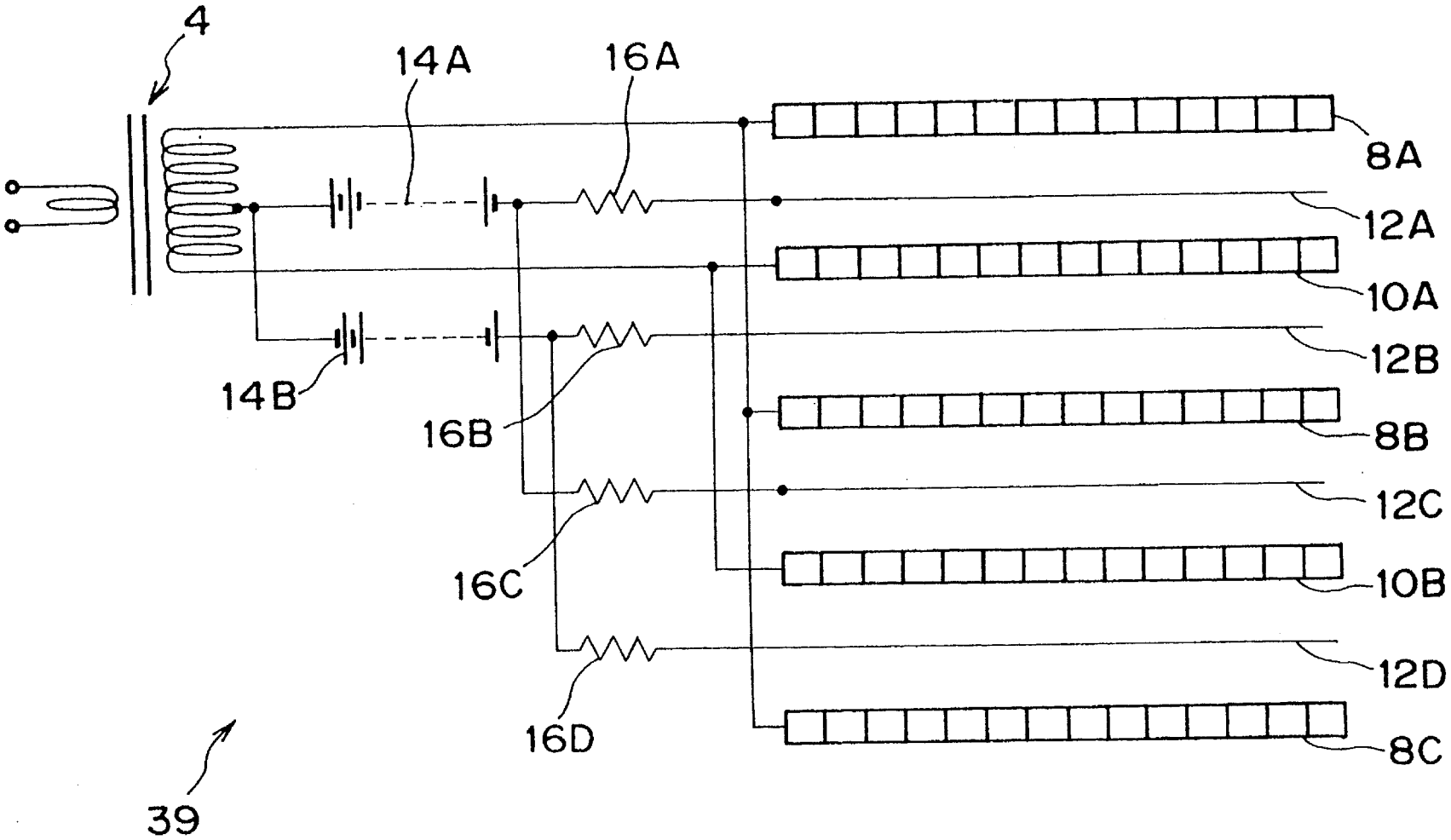
FIG. 9 is a connection diagram showing a speaker system according to the second embodiment.

As shown in FIG. 9, according to this embodiment, the speaker system 39 generates the large sound pressure by laminating multiple speaker elements.

In the case where these multiple speaker elements are laminated, the speaker system 39 forms the first speaker element with stationary electrodes 8A and 10A and the diaphragm 12A and then one stationary electrode of the second speaker element will be formed with the stationary electrode 10A placed under this first speaker element.

More specifically, the speaker system 39 arranges the stationary electrode 8B opposing to the stationary electrode 10A under the first speaker element, and arranges the diaphragm 12 between these stationary electrodes 10A and 8B and thus forms the second speaker element.

Furthermore, in these first and second speaker elements, the speaker system 39 connects the power source for forming bias voltage 14A and 14B to the mid tap of the boosting transformer 4, and each power source for forming bias voltage 14A, 14B will be connected to the diaphragm 12A and 12B via resistances 16A and 16B respectively, and thus, the bias voltage will be impressed to the diaphragms 12A and 12B with the opposite polarity each other.

Moreover, the speaker system 39 supplies the driving signal which is maintained in the same polarity to stationary electrodes 8A and 8B of the first and second speaker elements, and the driving signal maintained in the opposite polarity to the stationary electrode 10A, and thus impresses the driving signal with opposite polarity between the adjacent stationary electrodes.

Accordingly, even in the case where the stationary electrodes are used in common, the speaker system 39 can vibrate diaphragms 12A and 12B with the same phase and can reproduce the sound pressure to be expressed by the sum of diaphragms 12A and 12B.

With this arrangement, in the speaker device 39, since stationary electrodes are used in common in the first and second speaker elements, the first and second speaker elements can be arranged close to each other and accordingly, the large sound pressure can be obtained by the small shape.

Also, since diaphragms 12A and 12B can be arranged close to each other, the load of diaphragms 12A and 12B can be decreased and also the characteristic of the speaker system 39, as a whole, can be improved.

Furthermore, the speaker system 39 is composed of one stationary electrode of the third speaker element at the stationary electrode 8B under the second speaker element in like manner.

More specifically, the speaker system 39 arranges the stationary electrode 10B opposing to the stationary electrode 8B under the second speaker element, and arranges the diaphragm 12C between these stationary electrodes 8B and 10B thus forms the third speaker element.

Figure 1:
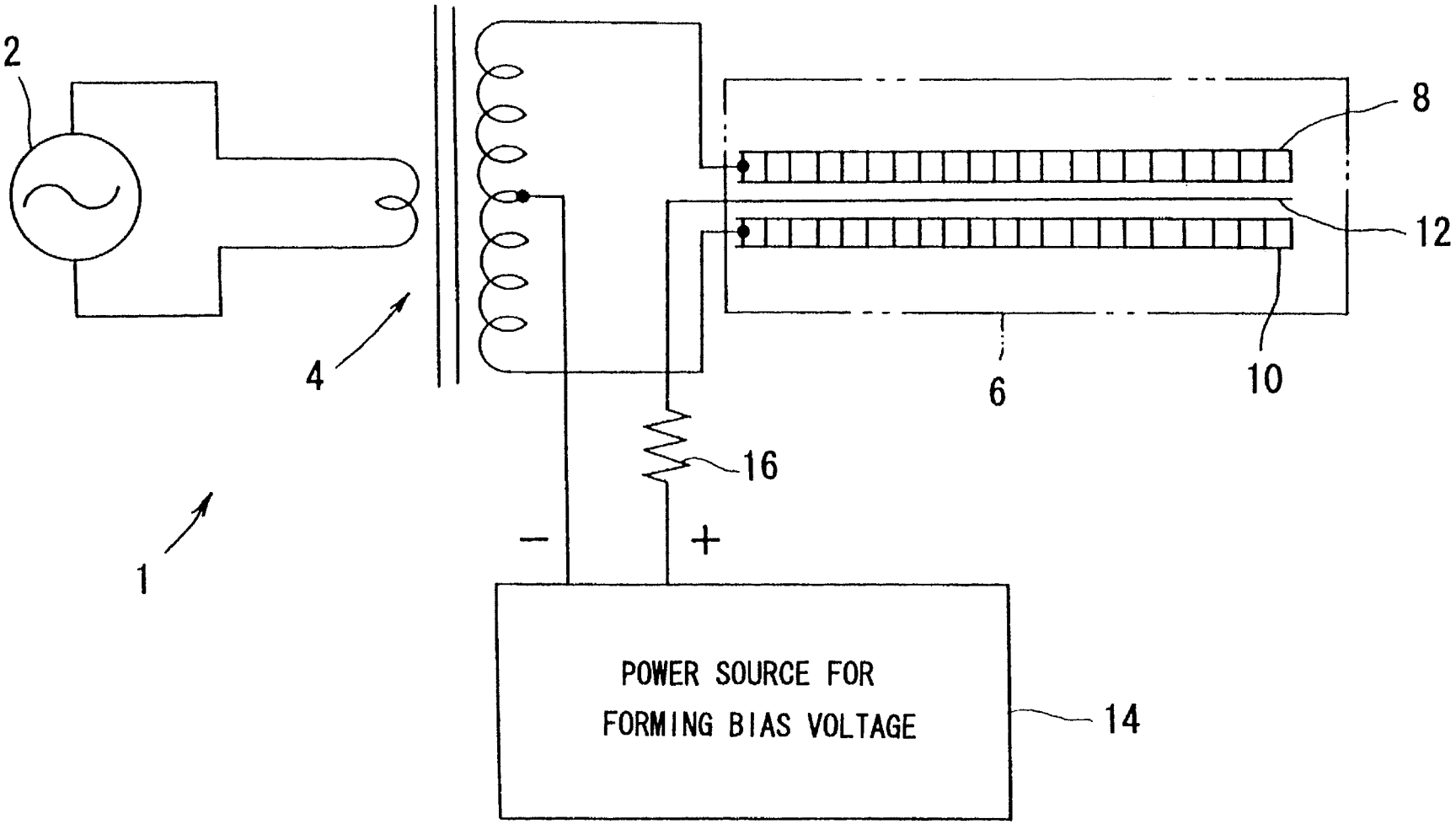
FIG. 1 (PRIOR ART)
FIG. 1 is a connection diagram showing the conventional speaker device.
Figure 2:
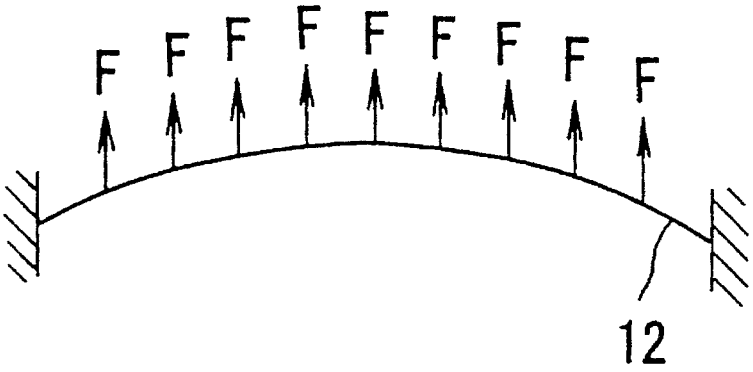
FIG. 2 (PRIOR ART)
FIG. 2 is a schematic view showing the driving force applying to the diaphragm in a speaker device showing in FIG. 1.
Figure 3:
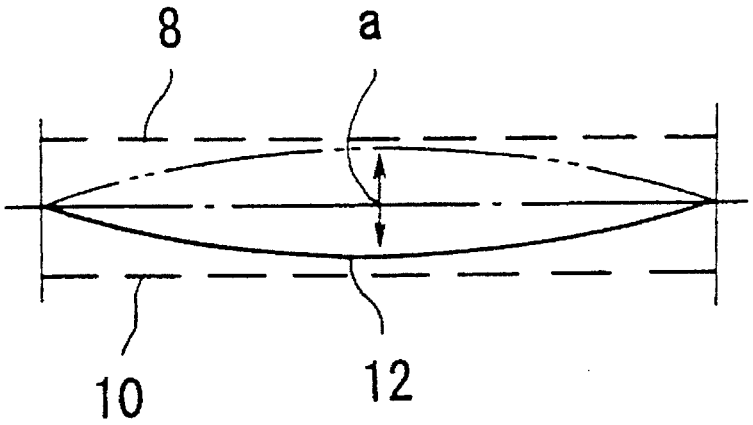
FIG. 3 (PRIOR ART)
FIG. 3 is a brief linear diagram illustrating the vibration of the diaphragm in a speaker system showing in FIG. 1.
Figure 4:
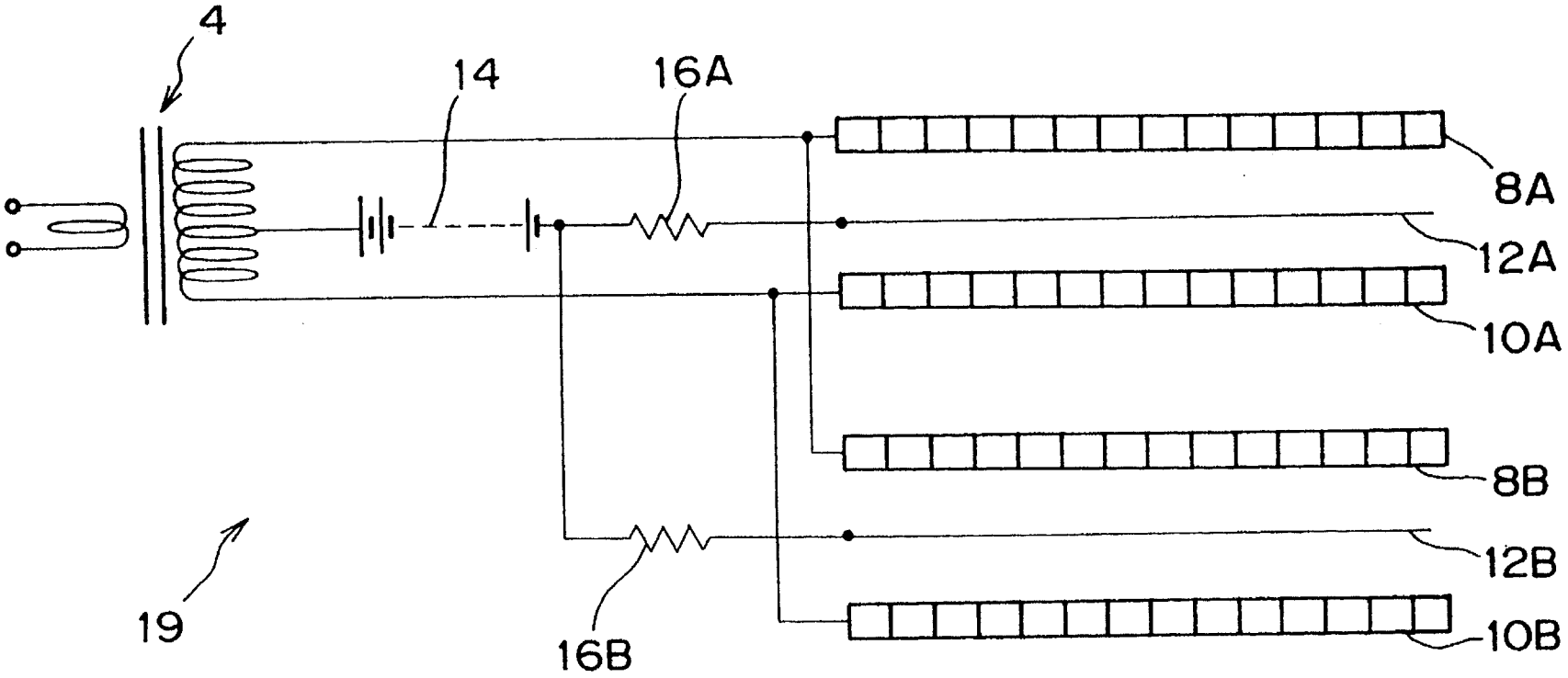
FIG. 4 (PRIOR ART)
FIG. 4 is a connection diagram showing a speaker system of conventional speaker elements laminated construction.

Thus in the speaker system 39, as described above in FIG. 4, three sets of speaker elements will be laminated with the thickness of 2 sets of speaker elements laminated, and thus, the overall shape can be minimized and the large sound pressure can be produced.

Furthermore, in a similar vein, the speaker system 39 arranges the stationary electrode 8C opposing to the stationary electrode 10B under the third speaker element, and arranges the diaphragm 12D between these stationary electrodes 10B and 8C and thus forms the fourth speaker element.

Moreover, the speaker system 39 connects these stationary electrodes 10B and 8C to the transformer 4 and simultaneously, connects power sources for forming bias voltage, 14A and 14B, to diaphragms 12C and 12D via resistances 16C and 16D respectively, and drives the third and fourth speaker elements in order that diaphragms 12C and 12D vibrate with the same phase as the diaphragm 12A.

With this arrangement, the speaker system 39 can generate the large sound pressure as expressed with the sum of these diaphragms 12A to 12D easily and with a small shape. And according to our experiment, the sound pressure sufficiently large enough for the practical usage could be produced by applying to a small sized enclosure.

According to the construction as shown in FIG. 9, by arranging multiple stationary electrodes to oppose each other in placing the diaphragm between, by impressing the bias voltage having the opposite polarity each other between neighboring diaphragms and impressing the driving signal of the opposite polarity between neighboring stationary electrodes, the stationary electrodes can be used in common between multiple speaker elements and these multiple speaker elements can be maintained laminated and thus, the speaker device capable of obtaining large sound pressure can be obtained with the small sized device.

(3) The Third Embodiment

Hereupon, according to the construction as shown in FIG. 9, since it is necessary to prepare two systems of power source for forming the bias voltage, it has a weak point that the general construction becomes complicated.

Therefore, according to this embodiment, two systems of bias voltage will be produced by one system power source for forming bias voltage.

Figure 10:
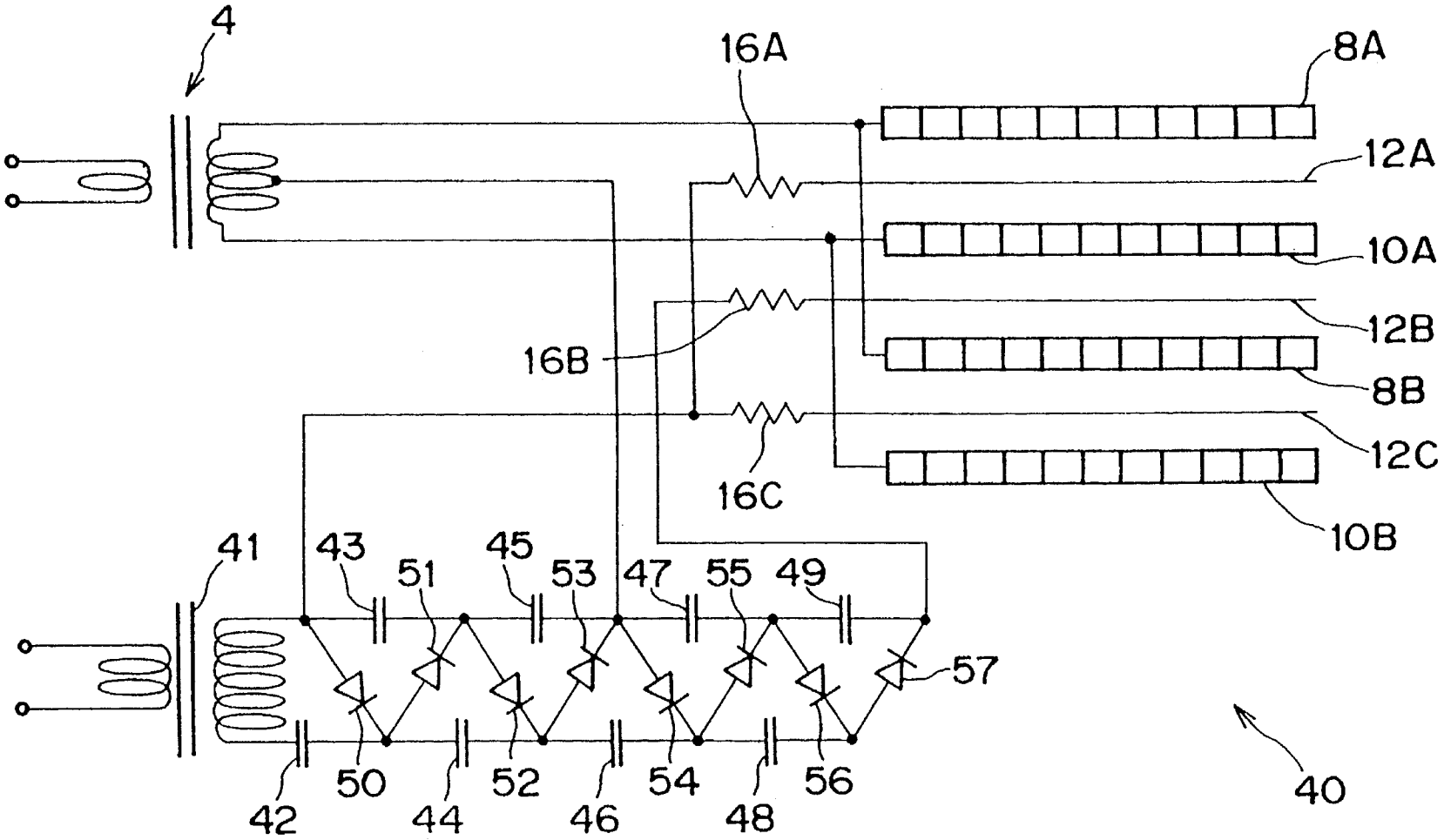
FIG. 10 is a connection diagram showing a speaker system according to the third embodiment.

More specifically, as shown in FIG. 10, the speaker system 40 inputs the commercial power source to the boosting transformer 41 and connects the secondary winding of this boosting transformer 41 to multi stage voltage doubler rectifier connected in ladder type with condensers 42 to 49 and diodes 50 to 57 for the prescribed number of stages.

Thus, the speaker system 40 can form the power source having high voltage in utilizing diodes and condensers with low resisting pressure.

Furthermore, the speaker system 40 connects the connecting mid point of condensers 45 and 47 to be maintained on medium potential for the output voltage of this multistage voltage doubler rectifier to the mid tap of the transformer 4, and connects the anode of diode 50 and the cathode of diode 57 to resistances 16A, 16C and resistance 16B respectively.

Thus, the speaker system 40 generates two systems of bias voltages by connecting the secondary output of a boosting transformer to the multistage voltage doubler rectifier ladder connected twice much stages of condensers and diodes than the ordinary stages, and thus, the general construction can be simplified.

According to the construction as shown in FIG. 10, the output of one boosting transformer is connected to multi stage voltage doubler rectifier and 2 systems of bias voltage can be formed by one boosting transformer in utilizing medium output of this multi stage voltage doubler rectifier, and thus, sufficient sound pressure can be produced with the simple construction.

(4) The Fourth Embodiment

Figure 11:
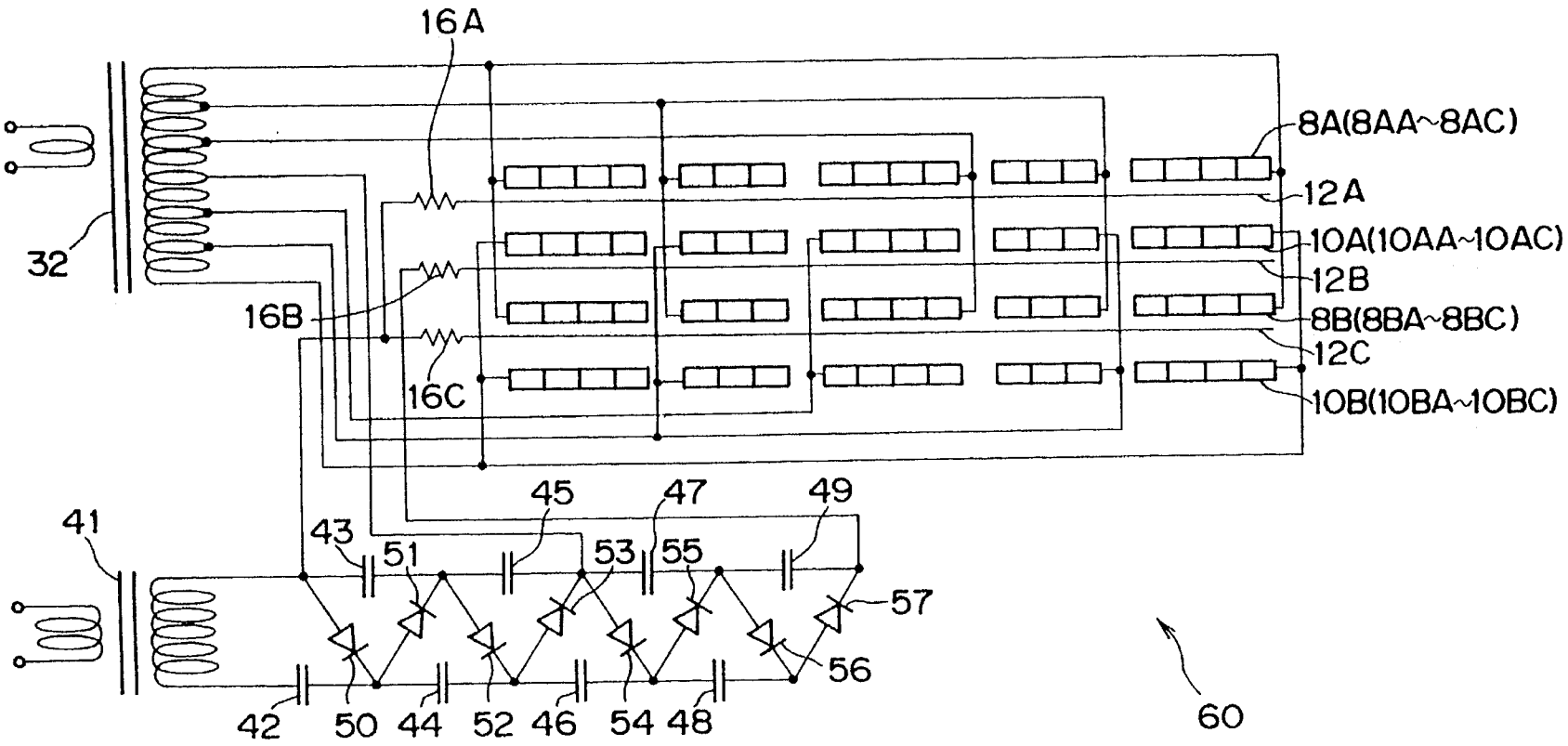
FIG. 11 is a connection diagram showing a speaker system according to the fourth embodiment.

As shown in FIG. 11, according to this embodiment, a speaker system 60 will be formed laminating multiple speaker elements by laminating multiple number of stationary electrodes 8A, 10A, 8B and 10B placing diaphragms 12A to 12C between, and moreover, as described above in the first embodiment, the sound pressure will be increased by dividing and forming electrodes 8A, 10A, 8B and 10B.

More specifically, in stationary electrodes 8A, 10A, 8B and 10B, rectangular electrodes 8AA, 10AA, 8BA and 10BA are arranged in the center flatly and frame shaped electrodes 8AB, 10AB, 8BB and 10BB are arranged outer side to surround these electrodes 8AA, 10AA, 8BA and 10BA and furthermore, frame shaped electrodes 8AC, 10AC, 8BC and 10BC are arranged to surround these frame shaped electrodes 8AB, 10AB, 8BB and 10BB.

With this arrangement, the speaker system 40 connects multiple number of electrodes 8AA to 10BC forming stationary electrodes 8A, 10A, 8B and 10B to the tap of transformer 32 respectively, and forms the electric field between stationary electrodes 8A, 10A, 8B and 10B in order to produce larger driving force in outer side of diaphragms 12A to 12C.

According to the construction as shown in FIG. 11, by laminating multiple number of stationary electrodes 8A, 10A, 8B and 10B placing diaphragm 12A to 12C between, the sound pressure can be increased and moreover, by forming stationary electrodes 8A, 10A, 8B and 10B with multiple electrodes 8AA to 10BC, the sound pressure can be further increased.

(5) The Fifth Embodiment

Then, in the speaker system utilizing this type of electrostatic speaker, it is necessary to connect the speaker system to the commercial power source by forming bias voltage from the commercial power source; and accordingly, its usability is worse as compared with the ordinary dynamic speaker device.

As one of the methods to obviate such problems, the method to form bias voltage from the driving signal can be considered. However, there is a possibility that distortion occurs in the driving signal and the quality of reproducing sound will be worsened and it is not practical.

Figure 12:
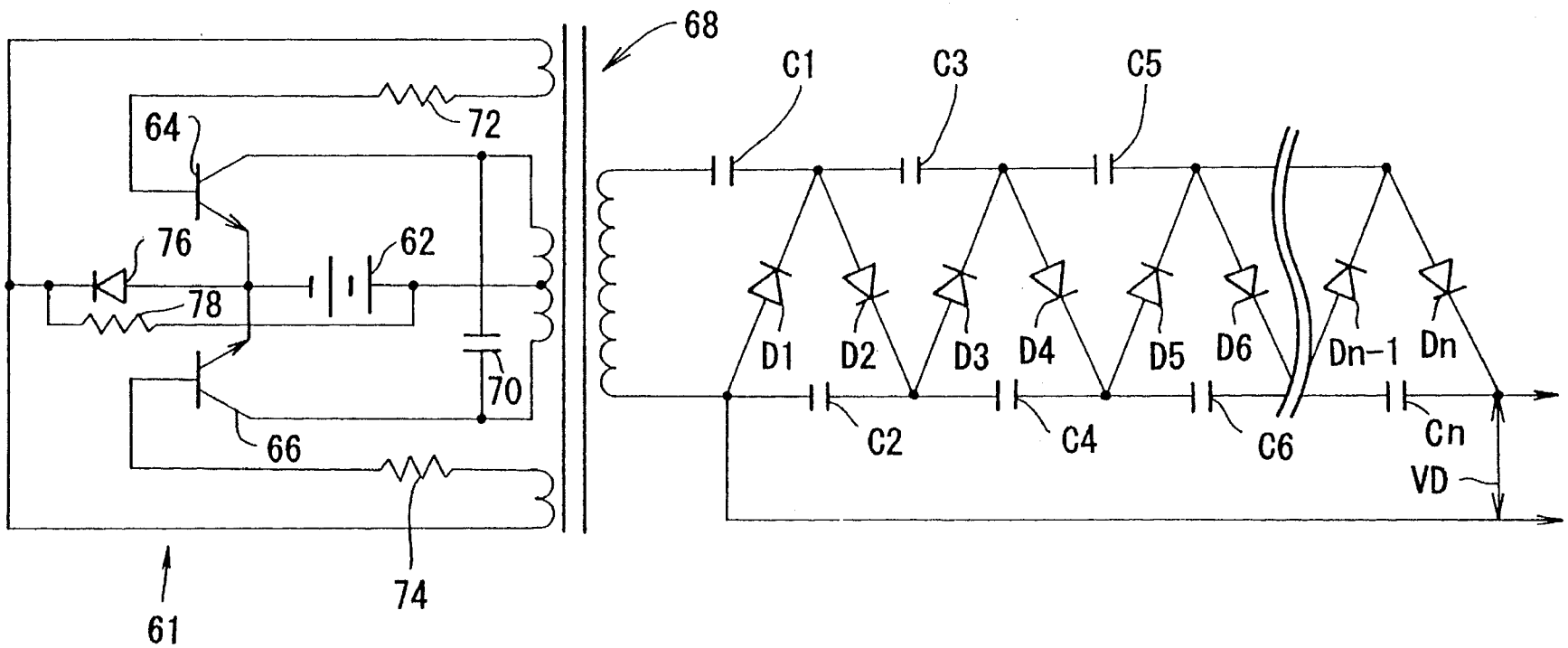
FIG. 12 is a connection diagram showing the power source circuit according to the fifth embodiment.

Therefore, as shown in FIG. 12, according to this embodiment, the power source for forming bias voltage 61 forms the bias voltage VD from the driving power source of battery 62 and thus, it can be used without connecting the speaker to the commercial power source.

More specifically, in this embodiment, the speaker system maintains the battery 62 exchangeable by applying to the direct current power source 14 of the first embodiment and connects this battery 62 to the power source for forming bias voltage 61.

The power source for forming bias voltage 61 connects emitters of transistors 64 and 66 to the battery 62 in common and connects collectors of these transistors 64 and 66 to the primary winding of the boosting transformer 68.

Here, the boosting transformer 68 has middle tap in the primary winding and connects this middle tap to the battery 62, and simultaneously, connects the condenser 70 comprising spark killer to terminals of both ends of the primary winding.

Furthermore, the boosting transformer 68 has a set of feedback winding besides the primary winding, and feedbacks output signals of this feedback winding to the base of transistors 64 and 66 through resistances 72 and 74.

With this arrangement, in the power source for forming bias voltage 61, an oscillation circuit composed of multi vibrator circuit and the output of this oscillation circuit will be outputted from the secondary winding to the boosting transformer 68.

Also in the power source for forming bias voltage 61, both ends of battery 62 will be connected to the feedback winding via diode 76 and resistance 78, and thus, oscillation function will be started with certainty.

On the other hand, the secondary winding of the boosting transformer 68 will be connected to the voltage doubler rectifier connected condensers C1-Cn and diodes D1-Dn in ladder type, and thus, the bias voltage VD with high voltage will be formed in utilizing low pressure-resisting diode and condenser.

With this arrangement, in the speaker system, bias voltage VD can be formed without connecting to the commercial power source and can be used in the same manner as a dynamic speaker device and accordingly, the usability can be improved.

Furthermore, in the speaker system, such as the case of forming the bias voltage VD from the driving signal, worsening of the sound quality can be avoided in advance.

In practice, in this type of bias voltage VD, there is almost no loss on the speaker side and the power source of battery 62 will be almost consumed at the power source for forming bias voltage.

Thus, even if the bias voltage VD will be formed by battery 62, practically sufficient lifetime can be secured, and since battery 62 will be replaced as occasion demands, it can be used permanently.

According to the construction of FIG. 12, the battery is kept exchangeable en bloc and the speaker system which can be used without connecting to the commercial power source can be obtained by forming bias voltage form the power source of battery, and thus, the usability of speaker system can be improved.

(6) Other Embodiments

Moreover, the first and fourth embodiments described above have dealt with the case of impressing driving signal to the stationary electrode by the boosting transformer having multiple taps. However, the present invention is not only limited to the above, but also driving signal may be impressed to each plate electrode in utilizing separate boosting transformer.

Furthermore, the first and fourth embodiments described above have dealt with the case of forming stationary electrode by arranging frame shaped plate electrode for rectangular plate electrode. However, the present invention is not only limited to the above, but also, for example, in the tweeter having slender shape, rectangular plate electrodes may be arranged successively along the longitudinal side and thus, driving signal may be impressed in order that electric field becomes larger in outer side in a direction of longitudinal side.

Moreover, the first to fourth embodiments described above have dealt with the case of outputting output voltage of the boosting transformers 4 and 32 directly to stationary electrode. However, the present invention is not only limited to the above, but also it may be outputted via resistance.

With this arrangement, the resistance value can be selected and sharpness Q of direct current oscillation circuit formed by the capacity element between inductance of the transformers 4 and 32 and the stationary electrode can be set to the desired value.

Furthermore, the second embodiment described above has dealt with the case of forming a speaker system by selecting 4 diaphragms and the third and fourth embodiments described above have dealt with the case of forming a speaker system by selecting 3 diaphragms. However, the present invention is not only limited to the above, but also number of diaphragms can be selected freely.

Furthermore, the first and fourth embodiments described above have dealt with the case of dividing each stationary electrode. However, the present invention is not only limited to the above, but also applicable the case of dividing and forming stationary electrodes of the uppermost side and the lowest side, stationary electrodes of the uppermost side and the lowest side, stationary electrodes to be divided and formed can be freely selected according to demands.

Moreover, the fifth embodiment described above has dealt with the case of driving the power source for forming bias voltage constantly during the speaker is driving. However, the present invention is not only limited to the above, but also oscillation of the power source for forming bias voltage may be stop controlled during the time bias voltage is kept at the prescribed voltage by setting a supplementary circuit. Accordingly, the battery can be used for a long period.

Furthermore, the fifth embodiment described above has dealt with the case of applying the battery driven power circuit to the first embodiment. However, the present invention is not only limited to the above, but also widely applicable to the second-fifth embodiments.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. An electrostatic loudspeaker system comprising:

a pair of stationary electrodes which are maintained to face each other in which multiple through holes are formed and on which a driving signal having different voltages is impressed;

a diaphragm, which is fixed at outer peripheral edges and is maintained between said pair of stationary electrodes and which forms a movable electrode having a direct current bias voltage impressed thereon, thereby generating a sound pressure by vibrating corresponding to said driving signal; and a boost means for boosting the driving signal impressed to said stationary electrodes: wherein;

said stationary electrodes are arranged in front and back of said diaphragm flatly, and are composed of multiple sheet electrodes insulated from each other: and said boost means impresses the driving signal having the different voltages on said multiple sheet electrodes respectively.

2. An electrostatic loudspeaker system according to claim 1, wherein:

said stationary electrodes are composed of multiple sheet electrodes having respective specific areas which are formed by dividing the areas from inner side to outer side; and said boost means impresses said driving signal to respective sheet electrodes in order that the electric field to be formed between said one pair of stationary electrodes by said driving signal becomes larger in outside circle compared with inside circle.

3. An electrostatic loudspeaker system according to claim 2, wherein said boost means is composed of a boost transformer for boosting said driving signal, and the boost transformer has at least one tap for outputting the tap output signal having lower voltage than an output signal of secondary side winding, and impresses said output signal of secondary side winding to said sheet electrodes of the outer circle side, and simultaneously impresses said tap output signal to said sheet electrodes of the inner circle side.

4. An electrostatic loudspeaker system according to claim 1, comprising:

a booster circuit for generating direct current bias voltage impressed to said diaphragm; and exchangeable batteries for supplying power source to the booster circuit: wherein the booster circuit and batteries are held temporarily.

5. An electrostatic loudspeaker system comprising:

first and second movable electrodes separated by a predetermined distance and arranged to oppose each other;

a first stationary electrode which is maintained between said first and second movable electrodes;

second and third stationary electrodes which are separated by the predetermined distance from said first and second movable electrodes and opposed to said first and the second movable electrodes in order to hold said first and second movable electrodes as well as said first stationary electrode respectively in the state that said first stationary electrode is maintained between said first and second movable electrodes;

a driving circuit for impressing an opposite polarity driving signal between said first and second stationary electrodes and said third and first stationary electrodes; and, a power source circuit for impressing an opposite polarity direct current bias voltage on said first and second movable electrodes respectively: wherein, said power source circuit has a boost transformer for outputting a secondary output voltage by boosting an alternating voltage, and a multi-stage junction circuit formed by connecting a plurality of stages of diodes and condensers in a ladder shape circuit, and a multi-stage voltage doubler rectifier for rectifying said secondary output voltage to form a double voltage by said multi-stage junction circuit and outputting an output from the voltage doubler.

6. An electrostatic type speaker apparatus according to claim 5 wherein:

a plurality of double voltage outputs are outputted from connecting stages among said multi-stage junction circuits, and simultaneously impressing the direct current bias voltage so that a plurality of multi-voltage outputs are impressed on said first and second movable electrodes which have the polarity opposite to each other.

7. An electrostatic loudspeaker system according to claim 6 wherein:

said first to third stationary electrodes are formed by multiple sheet electrodes which are arranged flatly and are insulated each other, said driving circuit impresses said driving signals which have different voltage respectively to the sheet electrodes.

8. An electrostatic loudspeaker system according to claim 7 wherein:

said stationary electrode is composed of multiple sheet electrodes having respective specific areas which are formed by dividing from inner side to outer side, and said driving circuit impresses said driving signal on respective ones of said sheet electrodes in order that an electric field formed between respective one of said stationary electrodes of said first to third stationary electrodes becomes larger in the outer side than the inner side relative to each stationary electrode.

9. An electrostatic loudspeaker system comprising:

a speaker unit having a pair of stationary electrodes to be maintained to face each other, in which multiple through holes are formed and on which a driving signal is impressed;

a diaphragm maintained between a pair of said stationary electrodes, which forms a movable electrode having a direct current bias voltage impressed thereon, and which generates a sound pressure by vibrating corresponding to said driving signal;

a battery for supplying the driving voltage for forming said direct current bias voltage;

a booster circuit for forming said direct current bias voltage upon boosting said driving voltage, said booster circuit comprising a pair of feedback windings on a primary side of a boosting transformer that has a primary side winding, said primary side winding having a middle tap connected to one side of said battery; and, an oscillation circuit having a pair of transistors, emitters of which are connected in common to the other side of said battery, wherein output signals of said pair of feedback windings are connected to feedback to the bases of said pair of said transistors, respectively, and the connection point of said emitters is connected to said feedback winding via a diode, and wherein said speaker unit, said battery and said booster circuit are maintained altogether en bloc.

10. An electrostatic loudspeaker system according to claim 9, wherein said battery is maintained to be exchangeable.

11. An electrostatic loudspeaker system according to claim 9, said booster circuit having a multi stage junction circuit, which is connected to secondary side winding of said boosting transformer, and formed by connecting a plurality of diodes and condensers in ladder shape; thus, the multi stage junction circuit rectify to double voltage to generate said direct current bias voltage.

* * * * *

UNITED STATES PATENT AND TRADEMARK OFFICE

CERTIFICATE OF CORRECTION

PATENT NO. : 5,471,540

DATED : November 28, 1995

INVENTOR(S) : Kenjiro Maeda

It is certified that error appears in the above-identified patent and that said Letters Patent is hereby corrected as shown below:

ON THE TITLE PAGE

Please add after item [22]: --Item [30], Foreign Application Priority Data
Oct. 24, 1992[JP].....Japan.....4-309707
Nov. 17, 1992[JP].....Japan.....4-332514
Aug. 17, 1993[JP].....Japan.....5-225245--.

Signed and Sealed this

Twenty-third Day of April, 1996

*Attest:*

*Attesting Officer*

BRUCE LEHMAN

*Commissioner of Patents and Trademarks*